United States Patent [19]

Jacobs

[11] 4,105,277

[45] Aug. 8, 1978

[54] ELECTRICAL CONNECTOR

[75] Inventor: Leonard Jacobs, Los Angeles, Calif.

[73] Assignee: TRW Inc., Redondo Beach, Calif.

[21] Appl. No.: 692,082

[22] Filed: Jun. 2, 1976

Related U.S. Application Data

[63] Continuation of Ser. No. 537,078, Dec. 30, 1974, abandoned.

[51] Int. Cl.[2] ..... H01R 13/20

[52] U.S. Cl. ..... 339/95 R; 339/258 T

[58] Field of Search ..... 339/95 R, 252 P, 258 T

[56] References Cited

U.S. PATENT DOCUMENTS

| | | | |
|---|---|---|---|
| 2,408,583 | 10/1946 | Slons | 339/61 R |
| 3,185,955 | 5/1965 | Keller | 339/95 R |
| 3,277,422 | 10/1966 | Shevlin | 339/252 P |
| 3,601,763 | 8/1971 | McNutt | 339/95 R |
| 3,815,081 | 6/1974 | Jones | 339/95 R |
| 4,025,148 | 5/1977 | Bovley | 339/258 T |

*Primary Examiner*—Neil Abrams

*Attorney, Agent, or Firm*—Neuman, Williams, Anderson & Olson

[57] ABSTRACT

A connector is disclosed wherein a plug member includes a plurality of plug pins rigidly mounted therein. Each of the plug pins includes a support portion with a torsion element and a contact member of elongated cross-section extending therefrom. The connector also includes a socket member including a plurality of rigidly mounted sockets of appropriate dimensions for receiving contact members of the plug member. Each of the sockets includes a throat section with an internal, laterally elongated cross-section, disposed a predetermined distance along the length of the socket. When the torsion elements are relaxed, the contact members are oriented to have their cross-sections misaligned relative to the throat sections of the sockets so as to place the aforementioned torsion elements in torsion when the contact members are forced into the throat sections of corresponding sockets as the plug and socket members are mated.

9 Claims, 7 Drawing Figures

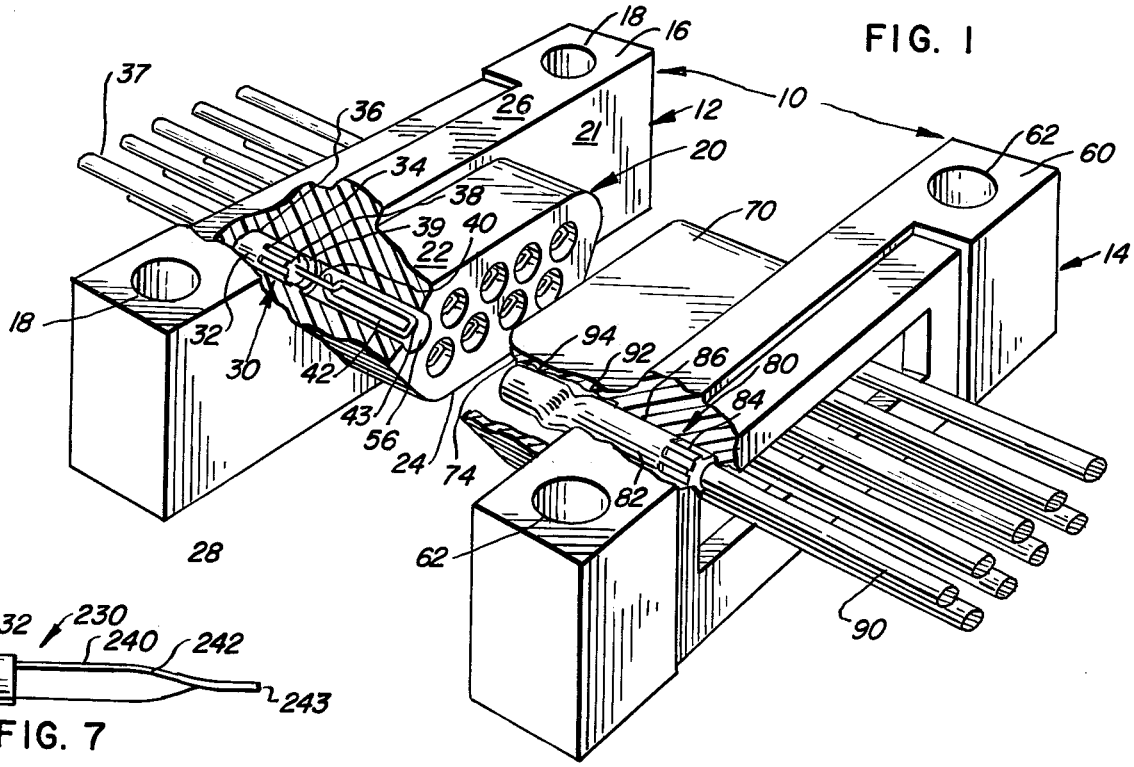
FIG. 1
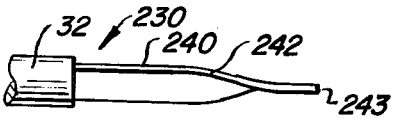
FIG. 7
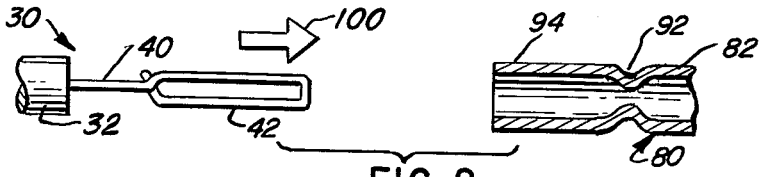
FIG. 2
FIG. 3
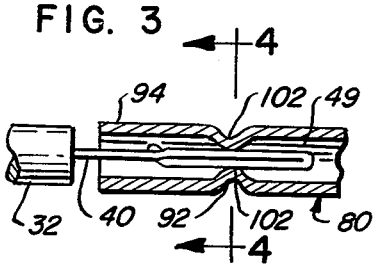
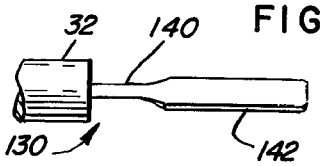
FIG. 5
FIG. 4
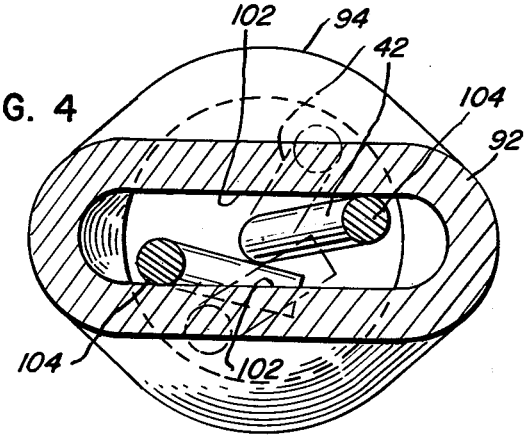
FIG. 6
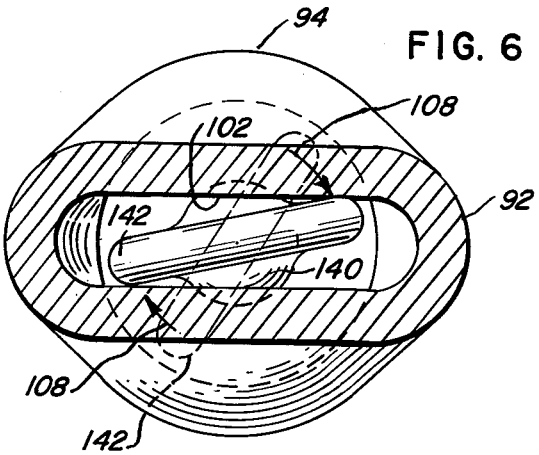

ELECTRICAL CONNECTOR

This is a continuation of application Ser. No. 537,078, filed Dec. 30, 1974 now abandoned.

This invention relates to electrical connection apparatus and particularly to electrical connection apparatus wherein contact between male and female elements is maintained by torsional forces.

With the continuing development of the electrical component arts and particularly with the development of miniature circuit boards have come needs for more reliable and smaller connectors for use with new components and with such circuit boards. It is desired that such connectors make firm connections which are not easily interrupted by external influences such as vibration or shock and yet have a useful life which is not greatly impaired by repeated disconnection and reconnection.

To achieve these results, various forms of connectors have been developed using torsional forces to maintain electrical contact between elements. By way of example, the following patents disclose some such connectors: Jones et al., U.S. Pat. No. 3,786,401, issued Jan. 15, 1974; A. J. Schmitt, U.S. Pat. No. 2,193,940, issued Mar. 19, 1940; Assmus et al., U.S. Pat. No. 3,693,139, issued Sept. 19, 1972; J. M. Sions, U.S. Pat. No. 2,408,583, issued Oct. 1, 1946; and Flanagan, U.S. Pat. No. 2,926,328, issued Feb. 23, 1960.

It is an object of this invention to provide improved electrical connectors.

It is a more specific object of this invention to provide improved connectors employing elements held in electrical contact by torsional forces.

Further and additional objects and advantages will appear from the description, accompanying drawings and appended claims.

In one specific embodiment of this invention, connector apparatus includes a plug assembly having a plurality of plug pins, each including a torsion portion or rod extending from a support portion rigidly mounted in the plug, and a contact member connected to the rod. A socket assembly is also provided including a plurality of rigidly supported sockets, each having a constricted, laterally elongated throat. Each contact member is so formed and aligned that when the plug assembly and socket assembly are mated, each contact member is rotated about the axis of the respective rod by elastic torsional strain of the rod and/or the contact member itself, whereby electrical contact with opposing walls of the constricted throat section of the corresponding socket is maintained by torsional stress energy stored in the respective contact member and connected rod.

For a more complete understanding of this invention, reference should now be had to the embodiments illustrated in greater detail in the accompanying drawings and described below by way of an example of the invention.

In the drawings:

FIG. 1 is an enlarged perspective view of the male and female members of a connector embodying the invention;

FIG. 2 is a schematic sectional view of a plug pin and a socket prior to mating;

FIG. 3 is a schematic sectional view of the plug pin and socket shown in FIG. 2, after mating;

FIG. 4 is an enlarged sectional view along the line 4—4 shown in FIG. 3 looking in the direction of the arrows;

FIG. 5 is a schematic view of an alternative embodiment of the plug pin shown in FIGS. 1 through 4;

FIG. 6 is a sectional view corresponding to FIG. 4, but with the plug pin of FIG. 5; and FIG. 7 is a schematic view of an alternative embodiment of the plug pin shown in FIGS. 1 through 4.

Referring to FIG. 1, a connector apparatus 10 includes a male connector or plug assembly shown generally at 12 and a female connector or socket assembly shown generally at 14. The plug assembly 12 includes an insulating plug base 16 of rectangular form, having mounting holes 18 extending therethrough. The insulating plug base 16 may be molded of phenolic resin or other suitable rigid insulating material of substantial mechanical strength. A protruding tongue 20 extends from a side 21 of the plug base 16. The tongue has a generally trapezoidal cross-section, including an upper surface 22 and a lower surface 24, the lower surface 24 being of a lesser dimension than that of the surface 22. The surfaces 22 and 24 are generally parallel to an upper surface 26 and a lower surface 28 of the plug base 16.

The plug assembly 12 includes a plurality of plug pins shown generally at 30. Each of these plug pins includes a support portion 32 having ribs 34 spaced around the circumference thereof. Each such support portion 32, including the ribs 34, closely engages the side walls of a tubular hole 36 in the base 16 of the assembly 12 and is secured thereto by appropriate application of an epoxy resin or other suitable adhesive. As a result, each support portion is rigidly mounted and cannot be rotated about its longitudinal axis. Each support member 32 is a tubular conductive element, and is connected at one end, by crimping or other suitable method, to one of a set of leads 37 which may be appropriate for termination of wires, either by wire wrap, solder or other means. Shoulders 38 at the other end of each support portion 32 abut an annular rib 39 at the end of each tubular hole 36.

Extending from each support portion 32 through the opening within each annular rib 39 is a wire torsion portion or rod 40 of each plug pin 30. The inner end of each rod 40 is rigidly secured in the respective support portion 32 in a manner to preclude relative rotational motion, such as by a crimping securement of the end of support 32 which may also form the ribs 34. If necessary, the rod 40 may be formed with a U-bend, or otherwise deformed at its inner end to aid in this securement. The distal end of each rod 40 is connected to a contact member or paddle 42 having an end portion 43. In the preferred embodiment, each paddle 42 is formed of a single piece of wire integral with the rod 40 and bent into an elongated rectangular shape as shown. However, as will be seen below, alternative forms of the paddle, such as those shown in FIGS. 5 and 7, are contemplated by the invention. In any event, each annular rib 39 is of an inside diameter greater than the dimension of each paddle 42 along its elongated transverse axis to permit such paddle to pass through the annular rib for ease of assembly of the plug assembly 12.

Each rod 40 and paddle 42 extends into a tubular cavity 56 in the tongue 20. The tubular cavities extend to the end of the tongue 20, and each is of sufficient diameter to not only permit free rotation of a paddle about the longitudinal axis of the rod 40, but also to receive a socket 80 of the socket assembly 14. The tongue 20 is of sufficient length to extend beyond the ends of the paddles 42.

The socket assembly 14 includes a socket base 60 having mounting holes 62 extending therethrough at the ends of the base 60. Extending from the base 60 is a sleeve-shaped tongue 70. As is well-known to those skilled in the art, the sleeve 70 is formed with inner surfaces appropriate to mate in close contact with the outer surfaces, such as surfaces 22 and 24, of the tongue 20. Thus, for instance, the sleeve 70 includes an upper inside surface 74 which is coplanar with the surface 22 of the tongue 20 when the two connectors are mated.

The socket assembly 14 includes a plurality of rigid sockets 80, each including a support portion 82. Each of the sockets 80 is rigidly mounted in a respective tubular hole 86 in the socket base 60, the support portion 82 and ribs 84 of the socket 80 tightly engaging the side walls of the hole 86 and being firmly secured thereto by an appropriate application of an epoxy resin or other suitable adhesive. Each support portion 82 is connected at one end to one of a set of leads 90 similar to leads 37, by crimping or other suitable method.

Each socket 80 includes a tubular throat portion 92, having a constricted cross-section, connected to the corresponding support portion 82 and a tubular entrance section 94 connected to the throat portion. Both the throat portion 92 and the portion 94 are of appropriate outside dimensions for entering a tubular cavity 56 of the tongue 20, and the portion 92 is of an inside diameter for receiving a paddle 42. In the illustrated embodiment, each socket 80 is an integral tubular conductive element which has been deformed by flattening to form the constricted throat section 92. The constricted section of each of the throat portions 92 has a passage therethrough which is elongated along a transverse axis that extends at an angle to the place of an unstressed paddle 42 of an aligned male connector 12; see the relative position of the relaxed or unstressed paddle shown in phantom lines in FIG. 4. Moreover, the minor axis of the passage through throat portions 92 is substantially less than the width of a paddle 42, as also seen in FIG. 4, such that a paddle must rotate toward alignment of its median plane with the major transverse axis of throat opening when entering a throat portion 92, as will be alluded to further below. In the illustrated embodiment, the constructed section of each of the throat portions 92 is elongated along an axis parallel to the surface 74 and also parallel to the surface 22 when the two assemblies are aligned for mating. Each paddle 42 is of a substantially flat or planar form, and is aligned along an axis which is not parallel to either of the surfaces 22 or 74. This axis is selected at an angle predetermined to ensure adequate contact forces without exceeding the elastic limit of the rod and paddle portions and depends upon the particular configurations of the paddle and the constricted throat portion, as well as the type of material of which the elements are made. An angle of between ten and fifty degrees is comtemplated for general use, although other angles may be necessary in specific situations.

Referring to FIG. 2, one plug pin 30 and a corresponding socket 80 are shown schematically, aligned for mating. The socket 80 is shown in section look along the aforementioned major transverse axis of the throad section 92. The relative radial orientation of the components is as represented by the phantom line position of paddle 42 in FIG. 4 relative to the socket shown in full lines. In mating, the plug pin 30 is moved in the direction of the arrow 100. The paddle 42 enters the end portion 94 and, as can be seen in FIG. 4, the paddle is forced between side walls 102 of the throat section 92. In so doing, the paddle 42 is rotated about the axis of the rod 40. More particularly, the walls of the socket in the transition from the entrance portion 94 to the throat 92 exert a rotary cam effect on the entering paddle 42 whereby the paddle is rotated from the normal, relaxed, phantom line orientation of FIG. 4 to the full line position of that figure. Since the support portion 32 is rigidly mounted, the rod 40 is placed in torsion as the paddle 42 is rotated and potential energy is stored in the elastic distortion of the rod 40. The concomitant restoring force of the rod forces the edges of the paddle 42 against the side walls 102 and thus ensures electrically conductive contact between the paddle and the socket 80. This contact action can be most clearly seen in FIG. 4 where the paddle 42 and the throat section 92 are in section. Specifically, it can be seen that the throat section 92 is of sufficient dimensions for permitting the paddle 42 to enter between the side walls 102. However, the throat opening is so oriented and constricted that the paddle must rotate from its initial relaxed alignment to the stressed alignment shown in FIG. 4 whereby force is applied by the conductors 104 to the side walls 102.

Referring to FIGS. 5–7, two alternative forms of plug pins 130 and 230 are shown schematically. In each instance the primary modification from the plug pin 30 is in the form of the paddle, and corresponding numbers in the 100 and 200 series are applied to like parts. The paddle 142 of pin 130 is a continuous planar or plate-like member of a thickness slightly less than the distance between the side walls 102 of the throat section 92. As can be seen particularly in FIG. 6, the paddle 142 is rotated in the direction of the arrows 108 from its original position, shown in phantom, to its contact position, shown in solid, as the paddle is inserted between the side walls 102. As a result, rod 140 is stressed and electrical contact is obtained in the same manner as described for the pin 30.

In the alternative embodiment of the paddle 242 shown schematically in FIG. 7, the paddle is twisted or skewed along its length, with its lateral edges describing a partial helix. Here, the end portion 243 may be aligned with the surface 22, i.e., generally parallel to the major transverse axis of the throat opening of the respective socket. Due to the skewed or spiral form, at least a portion of the body of the paddle 242 is not aligned with the surface 22. It should be further noted that the paddle 242 and torsion element 240 may be a continuous blade, extending from the support portion 32 as shown in FIG. 7. As the paddle 242 enters a throat section of a socket, the paddle itself will affort a cam action to establish the desired torsional stress of the rod 240. Accordingly, a cam surface is not required in the socket element, and the socket may be formed with a simple slot opening provided the leading edge 243 is aligned with that slot in the pre-mating orientation of the pin and socket components.

It will be obvious that modifications of the specific embodiments shown may be made without departing from the spirit and scope of the invention. For example, for ease or economy of manufacture, the paddle 42 and torsion member of each of the pins 30 may be, as indicated above, a continuous blade, and the entire pin may be appropriately stamped and formed from sheet metal into a suitable shape similar in functional aspects to the pin disclosed. In addition, the sockets may be formed with lateral shoulders along their respective longitudinal axes to aid assembly or to improve structural characteristics. Longitudinal striations or knurls may be employed along the support portions of both the pins and the sockets for improved rotational rigidity, and the support portions may be mounted in the respective base members by various additional methods including press fit, or spline fit.

It will be seen that improved connectors have been provided which meet the objects of the invention.

While particular embodiments of this invention have been shown, it will be understood, of course, that the invention is not limited thereto since modifications may be made by those skilled in the art, particularly in light of the foregoing teachings. Therefore, it is contemplated by the appended claims to cover any such modifications as incorporate those features which constitute the essential features of the improvements within the true spirit and scope of the invention.

What is claimed is:

1. A plug-in electrical connector assembly, including:

first and second base members which are maintained in predetermined mutual orientation when the components of the assembly are mated;

an electrical contact element having a portion thereof rigidly fixed to said first base member and including a free end portion extending from said first base member, said free end portion being resilient in torsion and terminating in a longitudinally elongated segment having an elongated transverse cross section; and an electrical conductor element, rigidly fixed at a first end thereof to said second base member, comprising a hollow tube including an inner surface and an opening, at the distal end of said conductor element, for receiving said elongated segment and having a transversely elongated, narrow constriction, constituted by a continuous portion of said inner surface, having a shape substantially complementary to said cross section of said segment but oriented with its major axis at a substantial angle relative to the cross section of said segment when said base members are in such predetermined mutual orientation, said constriction being substantially displaced within said hollow tube from the respective ends thereof, and means for guiding said segment into said constriction by elastic twisting of said contact element as one of said base members is moved toward the other in said predetermined mutual orientation;

wherein said longitudinally elongated segment is of sufficient length to extend through and substantially beyond said constriction when said assembly components are mated, whereby said electrical conductor element makes contact with said segment at a point substantially displaced from the end thereof.

2. A connector assembly as in claim 1 wherein said contact portion is substantially planar.

3. A connector assembly as in claim 1 wherein said contact portion is of a configuration such that each of its lateral edges forms a partial helix.

4. A connector assembly as in claim 1 wherein said conductor element comprises a support portion rigidly fixed to said second base and a throat portion extending from said support portion, said throat portion forming said transversely elongated narrow constriction.

5. Connector apparatus comprising:

plug apparatus including a base and a plurality of first connection elements;

each of said first connection elements having a support portion rigidly mounted in said plug base, and a torsion portion, terminating in an elongated contact portion, said contact portion having a predetermined polygonal cross section; and socket apparatus adapted for mating with said plug apparatus when said socket and plug apparatus are mutually aligned and including a plurality of rigidly mounted second connection elements;

each of said second connection elements comprising a substantially cylindrical, hollow tube, open at one end to receive a respective one of said contact portions, said tube having a laterally extending, closed, continuous inner surface portion forming a throat substantially displaced from the ends of said hollow tube including a laterally elongated passsage therethrough having a shape approximating said polygonal cross section but misaligned therewith when said plug and socket apparatus are aligned for mating, said continuous inner surface portion being formed to effect rotation of said contact portion through a predetermined angle about the longitudinal axis of said torsion portion when said socket and plug apparatus are mated;

said contact portions being of sufficient length to extend substantially through said respective passages and make contact with said passages only at a longitudinally intermediate portion of said respective contact portions when said socket and plug apparatus are mated.

6. Apparatus of claim 5 wherein said contact portions are planar paddles.

7. Apparatus of claim 5 wherein each of said contact members is of a configuration such that each of its lateral edges forms a partial helix.

8. A plug-in electrical connector assembly, including:

first and second base members which are maintained in predetermined mutual orientation when the components of the assembly are mated;

a first electrical contact element having a portion thereof rigidly fixed to said first base member and including a free end portion extending from said first base member, said free end portion being resilient in torsion and terminating in a longitudinally elongated segment having a cross section with a first axis whose length is less than one-half of said longitudinal dimension of said segment, and a second axis whose length is less than one-half of the length of said first axis;

a second electrical conductor element rigidly fixed to said second base member and comprising a substantially cylindrical tube having an inner surface, a portion of which is a closed, continuous surface forming a transversely oriented constriction therein, at a point substantially displaced from the ends of said hollow tube, with a major axis and a minor axis, said major axis being at a substantial angle to the first axis of said cross section of said segment when said base members are in such predetermined mutual orientation, said constriction being positioned such that said segment may be selectively inserted through said constriction to provide electrical contact between the wall of said tube and only a longitudinally intermediate portion of said segment, said inner surface also comprising means for guiding a substantial portion of said segment through and beyond said constriction and effecting elastic twisting of said first contact element as one of said base members is moved toward the other in said predetermined mutual orientation.

9. Connector apparatus comprising:

plug apparatus including a base and a plurality of first connection elements;

each of said first connection elements having a support portion rigidly mounted in said plug base, and a torsion portion, terminating in a longitudinally elongated contact portion, said contact portion having a cross section with a first axis whose length is less than one-half of the longitudinal dimension of said contact portion, and a second axis whose length is less than one-half of the length of said first axis; and socket apparatus adapted for mating with said plug apparatus when said socket and plug apparatus are mutually aligned and including a plurality of rigidly mounted second connection elements;

each of said second connection elements comprising a single tube having an open end and a crimped throat portion therein, displaced from said open end, including a constricted passage internally of said tube, formed by a closed, continuous inner surface of said crimped throat portion, having a shape approximating said cross section but misaligned therewith when said plug and socket apparatus are aligned for mating, and means for rotating said contact portion through a predetermined angle about the longitudinal axis of said torsion portion when said socket and plug apparatus are mated;

said contact portion being of sufficient length to extend through said passage and contact said tube only at said passage and only at a longitudinally intermediate portion of said contact portion.

* * * * *

UNITED STATES PATENT AND TRADEMARK OFFICE

CERTIFICATE OF CORRECTION

PATENT NO. : 4,105,277

DATED : August 8, 1978

INVENTOR(S) : Leonard Jacobs

It is certified that error appears in the above-identified patent and that said Letters Patent are hereby corrected as shown below:

In the first column of the patent, under "References Cited", the name of the first patentee should be -- Sions -- instead of "Slons"

The name of the last patentee should be -- Bouley -- instead of "Bovley"

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*